US010962216B2

(12) United States Patent
Chen et al.

(10) Patent No.: US 10,962,216 B2
(45) Date of Patent: Mar. 30, 2021

(54) LED LIGHT SOURCE APPARATUS, LIGHTING DEVICE, AND LIGHTING CONTROL METHOD

(71) Applicants: Shanghai Sansi Electronic Engineering Co., Ltd., Shanghai (CN); Sansi Optoelectronics Technology (Shanghai) Co., Ltd., Shanghai (CN); Shanghai Sansi Technology Co., Ltd., Shanghai (CN); Jiashan Sansi Optoelectronic Technology Co., Ltd., Jiaxing (CN)

(72) Inventors: Bishou Chen, Shanghai (CN); Peng Wang, Shanghai (CN); Xiaoliang He, Shanghai (CN); Luping Miu, Shanghai (CN)

(73) Assignees: Shanghai Sansi Electronic Engineering Co. Ltd., Shanghai (CN); Sansi Optoelectronics Technology (Shanghai) Co. Ltd., Shanghai (CN); Shanghai Sansi Technology Co. Ltd., Shanghai (CN); Jiashan Sansi Optoelectronic Technology Co. Ltd., Zhejiang (CN)

( * ) Notice: Subject to any disclaimer, the term of this patent is extended or adjusted under 35 U.S.C. 154(b) by 0 days.

(21) Appl. No.: 16/367,282

(22) Filed: Mar. 28, 2019

(65) Prior Publication Data

US 2019/0219258 A1 Jul. 18, 2019

(51) Int. Cl.

| | |
|---|---|
| ***F21V 29/503*** | (2015.01) |
| ***F21V 29/83*** | (2015.01) |
| ***F21V 29/77*** | (2015.01) |
| ***H05B 45/20*** | (2020.01) |
| ***F21Y 113/13*** | (2016.01) |
| ***F21Y 105/18*** | (2016.01) |
| ***F21Y 115/10*** | (2016.01) |

(52) U.S. Cl.

CPC ..... *F21V 29/503* (2015.01); *F21V 29/773* (2015.01); *F21V 29/83* (2015.01); *H05B 45/20* (2020.01); *F21Y 2105/18* (2016.08); *F21Y 2113/13* (2016.08); *F21Y 2115/10* (2016.08)

(58) Field of Classification Search

None

See application file for complete search history.

(56) References Cited

U.S. PATENT DOCUMENTS

| | | | | |
|---|---|---|---|---|
| 8,928,023 | B1 * | 1/2015 | Coleiny | F21V 23/04 257/98 |
| 9,897,298 | B2 * | 2/2018 | Shin | F21K 9/00 |
| 2006/0139916 | A1 * | 6/2006 | You | F21V 7/0091 362/231 |

(Continued)

FOREIGN PATENT DOCUMENTS

| | | | | |
|---|---|---|---|---|
| CN | 108071954 A | * | 5/2018 | F21V 29/74 |

*Primary Examiner* — Britt D Hanley

(57) ABSTRACT

Disclosed are an LED light source apparatus, a lighting device, and a lighting control method. The LED light source apparatus includes a plurality of light mixing units. Each light mixing unit comprises LED chips of at least four colors, and the at least four colors at least include red and green. The plurality of light mixing units is uniformly distributed on a bearing surface along a ring.

8 Claims, 4 Drawing Sheets

(56) References Cited

U.S. PATENT DOCUMENTS

2011/0037388 A1* 2/2011 Lou ..... F21K 9/232
315/35
2016/0040854 A1* 2/2016 Zhang ..... H01L 25/0753
362/242
2019/0242569 A1* 8/2019 Jiang ..... F21K 9/68

* cited by examiner

LED LIGHT SOURCE APPARATUS, LIGHTING DEVICE, AND LIGHTING CONTROL METHOD

BACKGROUND OF THE DISCLOSURE

Field of Disclosure

The present disclosure relates to the field of lighting technology, and in particular, to a light emitting diode (LED) light source apparatus, a lighting device, and lighting control method.

Description of Related Arts

LED products are a new solid-state cold light source based on semiconductor light emission. The continuously increasing of technology in recent years has improved LED light efficiency, light colors, color rendering, and reduced the junction temperature and thermal resistance. The large-scale mass production has greatly reduced the price of an LED light source. LED lighting, as a new-generation green lighting light source, has unique advantages such as high efficiency, energy saving, environmentally friendly, long service life, and easy to maintain.

At present, more and more consumers that pay attention to LED lighting quality rather than merely light efficiency of LEDs. LED high-quality illumination has emerged as required. High-quality lighting is conducive to psychological and physiological comfort and is capable of improving the quality and efficiency of life and work.

At present, LED lighting products on the market can already achieve high light efficiency, and consumer products with light efficiency more than 150 lm/W, or more than 200 lm/W are common. However, besides light efficiency, there are many indexes that affect lighting quality, such as color rendering index and brightness stability. At present, LEDs on the market usually have color rendering indexes lower than 85 and have poor brightness stability. It has become a research hotspot of numerous companies and research institutes to improve these indexes and apply LEDs to goods for civil use at low costs.

In addition, currently, three primary colors (RGB) of a lamp do not have a good protection effect on eyes, and blue light is very harmful to human eyes. If blue light is reduced, a color rendering coefficient of a three-primary-color lamp is greatly reduced, and the lighting effect thereof is poor. Therefore, how to ensure blue light to be reduced and ensure the color rendering coefficient not to be reduced at the same time has become a problem that needs to be immediately resolved in current LED lighting.

SUMMARY

The present disclosure provides an LED light source apparatus, comprising a plurality of light mixing units, each light mixing unit comprises LED chips having at least four colors, and the at least four colors at least comprise red and green; the plurality of light mixing units is uniformly distributed on a bearing surface along a ring.

In an embodiment of the present disclosure, the LED chips in each light mixing unit are uniformly distributed on the bearing surface along a ring.

In an embodiment of the present disclosure, the LED chips in the plurality of light mixing units are uniformly distributed on the bearing surface along a same ring.

In an embodiment of the present disclosure, a heat conductive connecting layer is disposed between the plurality of light mixing units and the bearing surface, and the heat conductive connecting layer is provided with a conductive circuit electrically connected to the LED chips in the light mixing units.

In an embodiment of the present disclosure, the bearing surface is located on a base.

In an embodiment of the present disclosure, an auxiliary heat dissipation structure is provided on the base, the auxiliary heat dissipation structure comprises a hollow ventilation portion and/or heat-dissipation ribs.

In an embodiment of the present disclosure, each light mixing unit comprises LED chips of four or five colors.

In an embodiment of the present disclosure, colors, except red, green, and blue in the at least four colors, of some or all of LED chips are located within a color gamut triangle having the red, the green, and the blue as vertices.

The present disclosure further provides an LED lighting device, comprising the LED light source apparatus.

The present disclosure further provides an LED lighting control method, applied to an LED lighting device, where the LED lighting device comprises the LED light source apparatus; and the method comprises: controlling a color temperature and/or a color of light emitted from the LED lighting device.

In an embodiment of the present disclosure, the color temperature ranges from 2700K to 6500K.

As stated above, the LED light source apparatus comprises a plurality of light mixing units. Each light mixing unit comprises LED chips of at least four colors. The at least four colors at least comprise red and green. The plurality of light mixing units is uniformly distributed on a bearing surface along a ring. Through mixing of light of the at least four colors, not only more abundant colors can be achieved, but also high light efficiency and color rendering index can be achieved.

DETAILED DESCRIPTION OF THE PREFERRED EMBODIMENTS

Implementations of the present disclosure are described below by using particular specific instances, and a person skilled in the art may easily learn of other advantages and effects of the present disclosure from the content disclosed in this specification. The present disclosure may also be implemented or applied by using additional different specific implementations, and various modifications or changes may be made to various details in this specification based on different opinions and applications without departing from the spirit of the present disclosure. It should be noted that in a case of no conflict, the following embodiments and features in the embodiments can be mutually combined.

It should be noted that accompanying drawings provided in the following embodiments illustrate, by way of illustration only, the basic concepts of the present disclosure and are merely illustrative of the components that are pertinent to the present disclosure and are not drawn to scale, shape and number of components in actual practice, which may vary widely in type, number and proportions, and which may be more complex in component layout.

The present disclosure relates to technical improvement in the field of lighting technology, and in particular, to an LED lighting technology. LED light source, comprising LED chips of colors other than RGB three primary colors, are adjusted, so that mixed light thereof can achieve more colors and achieve color temperature control for maintaining high light efficiency and color rendering index.

Figure 1:
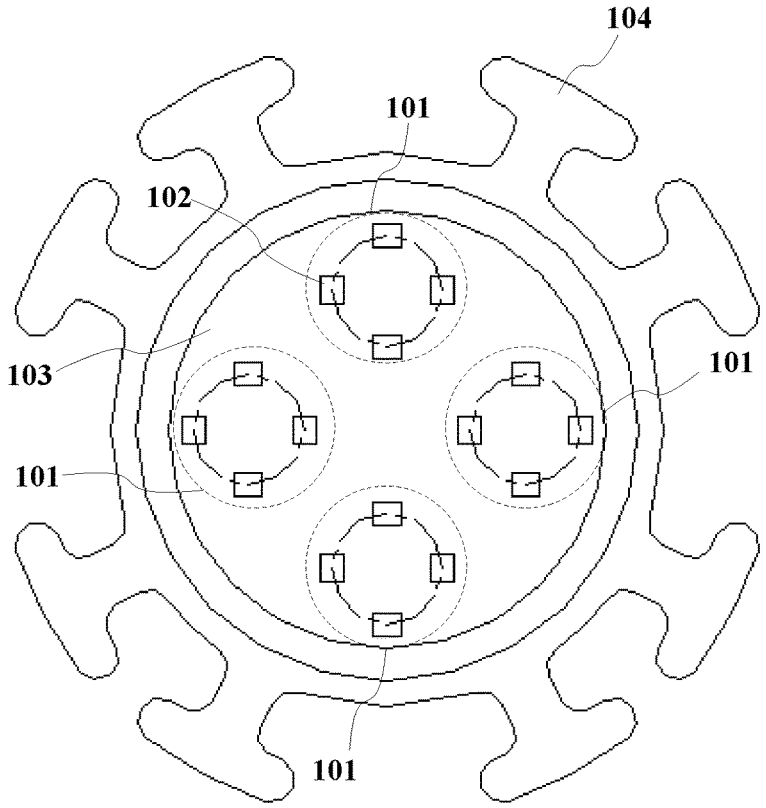
FIG. 1 is a structural diagram of an LED light source apparatus in an embodiment of a first implementation according to the present disclosure.

FIG. 1 is a structural diagram of an LED light source apparatus in a first implementation according to the present disclosure.

The LED light source apparatus comprises a plurality of light mixing units 101. Each light mixing unit 101 includes LED chips 102 of at least four colors. The at least four colors at least include red and green. The plurality of light mixing units 101 is uniformly distributed on a bearing surface along a ring. In this embodiment, each of the plurality of light mixing units 101 includes LED chips 102 of four colors, colors of LED chips 102 other than red and green LED chips 102 may not be limited, and may be, for example, two of white, yellow, blue green, purple, yellowish red (orange), and the like. One of the colors may be blue. However, in order to protect eyes, blue light should be avoided.

In addition, in this embodiment, the LED chips 102 in the light mixing units 101 are uniformly distributed on the bearing surface along a small ring, and the plurality of light mixing units 101 is uniformly distributed on the bearing surface along a large ring.

In an embodiment of the present disclosure, the bearing surface may be located on a base 103. The bearing surface may be made of a ceramic material. The base 103 is mounted on an LED lighting device, that is, an LED lamp. Optionally, an auxiliary heat dissipation structure may be provided on a surface of the base 103. The auxiliary heat dissipation structure includes a hollow ventilation portion and/or heat-dissipation ribs. In this embodiment, the heat dissipation area of the surface of the base 103 is increased through a plurality of T-shaped heat-dissipation ribs 104, the increased heat dissipation area facilitates heat dissipation. Certainly, this is only an example, changes may be made in other embodiments, and the present disclosure is not limited thereto.

Optionally, a heat conductive connecting layer (not shown) is disposed between the plurality of light mixing units 101 and the bearing surface, and the heat conductive connecting layer is provided with a conductive circuit electrically connected to the LED chips 102 in the light mixing units 101.

Specifically, with reference to a previously disclosed document Chinese Patent Application No. 20159000078.8 and entitled "LIGHT EMITTING APPARATUS AND LED LAMP COMPRISING THE SAME", it can be known that a cathode pin and an anode pin of the LED chip 102 may be electrically connected, for example, welded, to a wire in the thermally conductive connecting layer, so as to form an electric circuit electrically connecting the LED chip 102 and the outside.

Figure 2:
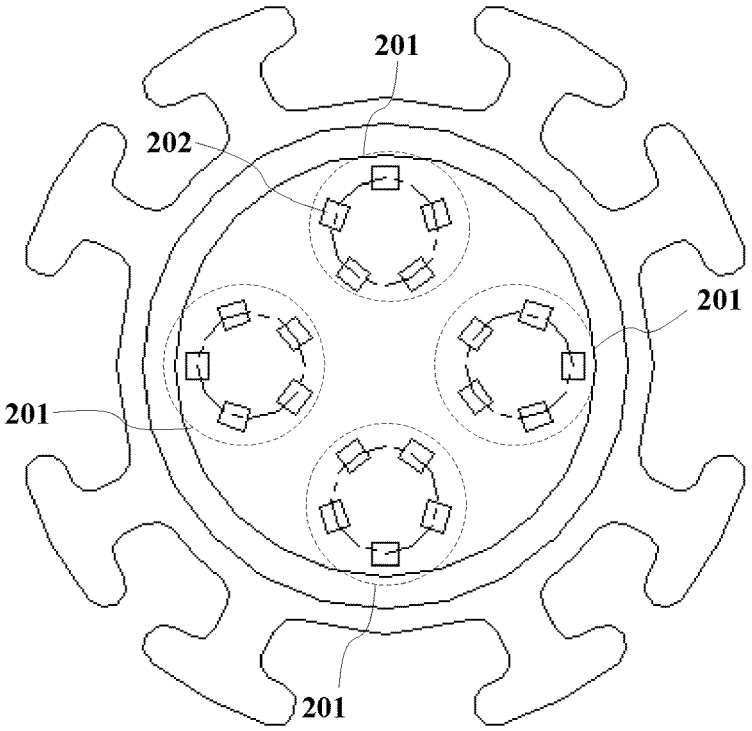
FIG. 2 is a structural diagram of an LED light source apparatus in another embodiment of the first implementation according to the present disclosure.

FIG. 2 is a structural diagram of an LED light source apparatus in another embodiment of the first implementation according to the present disclosure.

Compared with the embodiment of FIG. 1, the difference mainly lies in that each light mixing unit 201 comprises LED chips 202 of five colors. Each light mixing unit 201 comprises a red LED chip and a green LED chip, and the LED chips of the other three colors is not limited, may be for example any three of white, yellow, blue green, purple, yellowish red (orange), and the like.

In the two embodiments shown in FIG. 1 and FIG. 2 in the first implementation of the present disclosure, light mixing units is implemented by distributing the LED chips along a ring, thereby achieving uniform light output. The structure of the light mixing units is not limited thereto.

In a second implementation of the present disclosure, the LED chips in the plurality of light mixing units are uniformly distributed on the bearing surface along the same ring.

Figure 3:
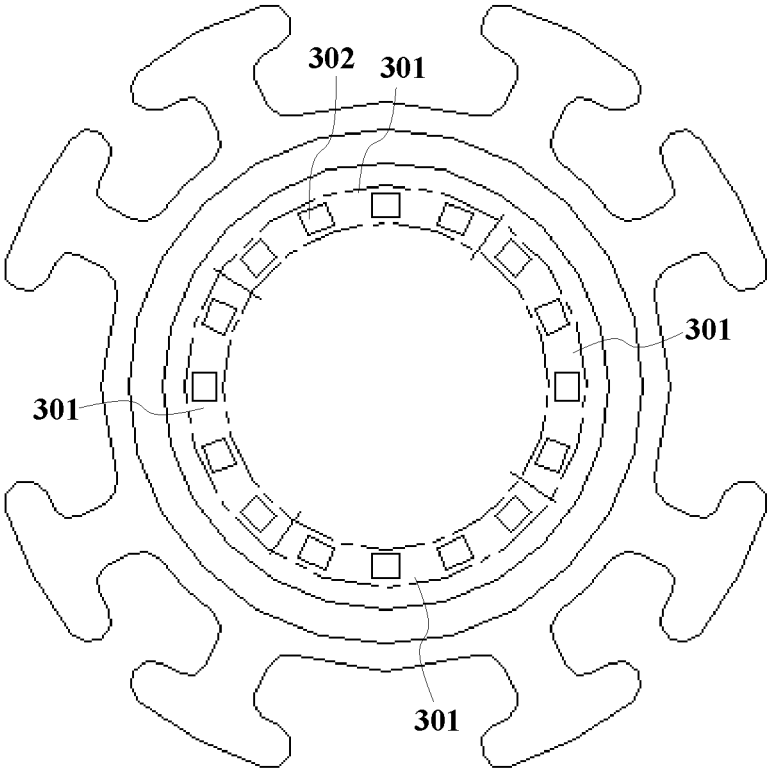
FIG. 3 is a structural diagram of an LED light source apparatus in an embodiment of a second implementation according to the present disclosure.

FIG. 3 is a structural diagram of an LED light source apparatus in a first embodiment of the second implementation according to the present disclosure.

In this embodiment, four light mixing units 301 (vertical lines are used in the figure as separation marks between the light mixing units 301) distributed along a ring are shown. Each light mixing unit 301 comprises LED chips 302 of four colors, the LED chips 302 are located on the ring. Each light mixing unit 301 occupies ¼ of the ring, and the four LED chips 302 of each light mixing unit 301 are uniformly distributed at the ¼ of the ring.

Certainly, similar to the colors of the LED chips in the embodiment shown in FIG. 1, the remaining colors, other than red and green, of the four colors of the LED chips 302 in each light mixing unit 301 are not limited.

In addition, preferably, on the ring, the four colors of the LED chips 302 are distributed along a predetermined arrangement order, for example, "red-green-Y (representing the third color)-X (representing the four color)-red-green-Y-X . . . red-green-Y-X". Certainly, this is merely an example, and the present disclosure is not limited thereto.

Figure 4:
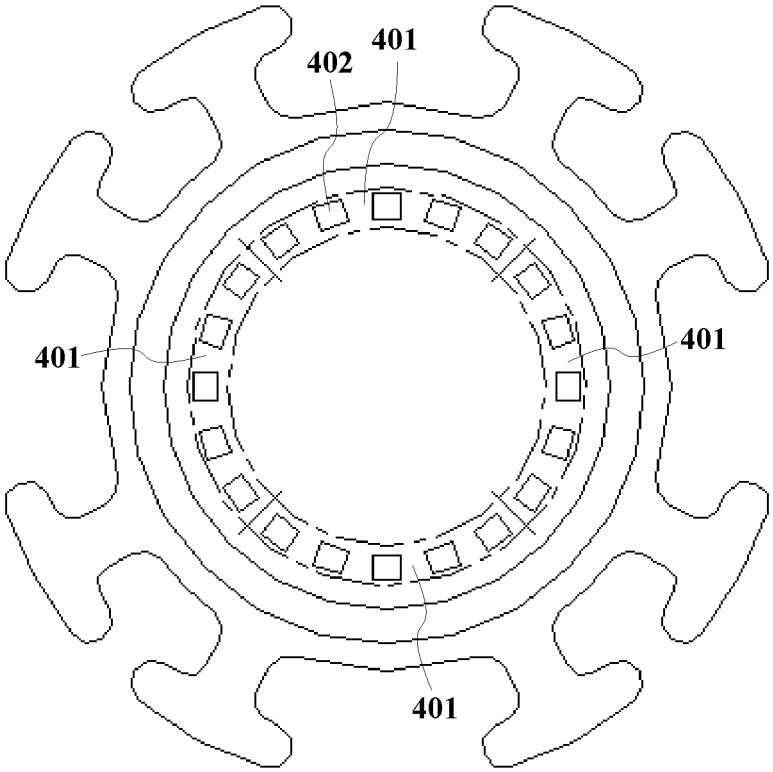
FIG. 4 is a structural diagram of an LED light source apparatus in another embodiment of the second implementation according to the present disclosure.

FIG. 4 is a structural diagram of an LED light source apparatus in a second embodiment of the second implementation according to the present disclosure.

A difference between this embodiment and the embodiment shown in FIG. 3 mainly lies in that each light mixing unit 401 in this embodiment comprises LED chips 402 of five colors. Therefore, each light mixing unit 401 occupies ⅕ of the ring, and the five LED chips 402 of the light mixing unit 401 are uniformly distributed at the ⅕ of the ring.

The remaining three colors, other than red and green, of the five colors of the LED chips 402 are not limited.

In a color gamut space coordinate system, red, green, and blue are three vertices, and colors corresponding to mixed lights need to be within a three primary color gamut triangle formed by the three vertices. As shown in FIGS. 1 to 4 of the present disclosure, lights of at least four colors are mixed, if, for example, one or two colors other than the three primary colors are outside the color gamut triangle, a new vertex is formed, the color gamut becomes a polygon such as a quadrangle and pentagon which has a larger area, so that a color available range that can be achieved by the mixed light is larger. That is, colors are richer. High light efficiency and a high color rendering index can be achieved.

With the LED lighting device of the LED light source apparatus according to the present disclosure, colors of mixed light are richer than those of an existing LED lighting device, and the LED lighting device of the LED light source apparatus according to the present disclosure can achieve high light efficiency and a high color rendering index. The LED lighting device may be, for example, a bulb lamp, a ceiling lamp, a desk lamp, a neon lamp, and a metro lamp.

In some embodiments, the present disclosure further provides a lighting control method applied to the LED lighting device, the method controls light emitted from the LED light source apparatus electrically connected to the LED lighting device by using an LED drive circuit in the LED lighting device. The LED drive circuit adjusts the color temperature, the colors, and the like of light emitted from the LED light source are well known, and are not described in detail herein.

Figure 5:
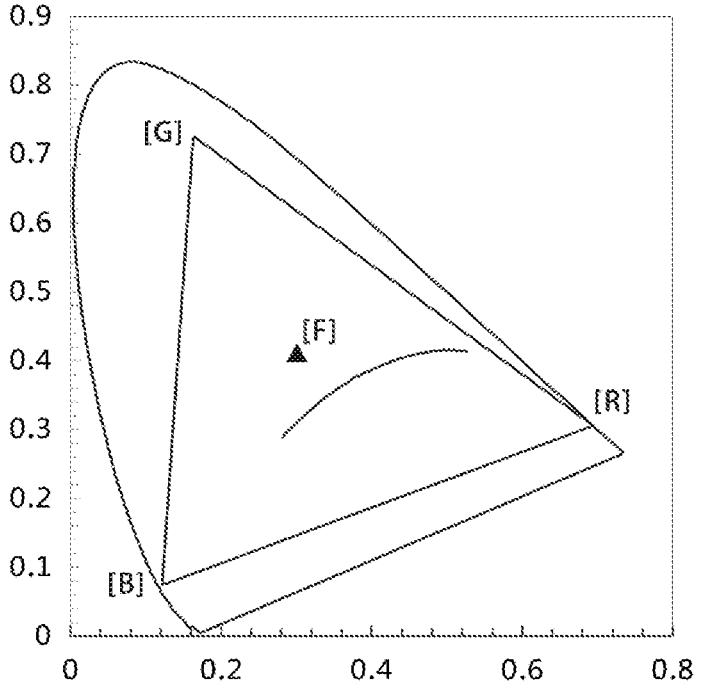
FIG. 5 is a diagram of applications of the white light generated at different color temperatures by mixing three primary colors in an embodiment according to the present disclosure.

Specifically, as shown in FIG. 5, [R], [G], and [B] are coordinates of mixed three primary colors, and [F] is coordinates of a final mixed color. In this embodiment, three primary colors [R], [G], and [B] are mixed, and brightness levels of the primary colors have 256 in total, which respectively are 0 to 255. Therefore, theoretical colors achieved through color mixing are within a color gamut triangle having [R], [G], and [B] as vertices, and the theoretical number of colors is $256^3=16777216$.

The lighting control method achieved by the LED lighting device according to the present disclosure can achieve richer colors, high light efficiency, and a high color rendering index.

Figure 6:
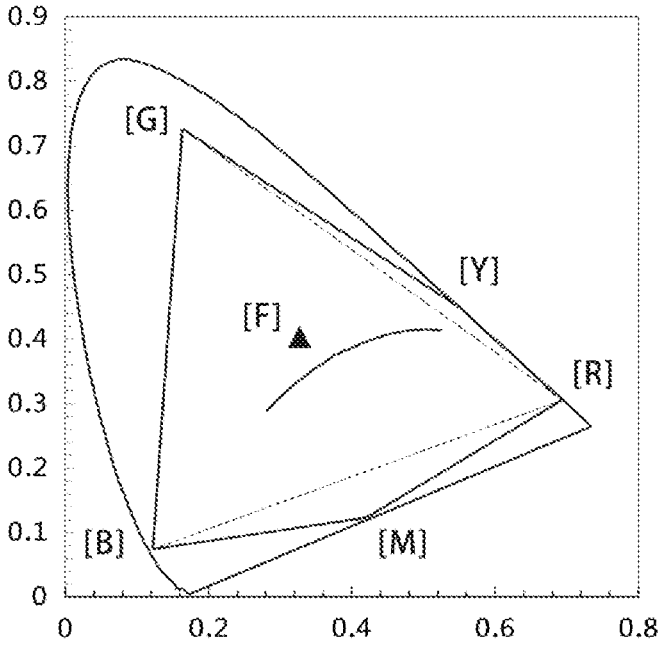
FIG. 6 is a diagram of applications of colors generated by mixing five primary colors in an embodiment according to the present disclosure.

Assuming that there are five colors shown in the embodiment of FIG. 2 or FIG. 4, as shown in FIG. 6, [R], [G], and [B] are coordinates of mixed three primary colors, [Y] and [M] are the fourth and fifth mixed primary colors, and [F] is coordinates of the final mixed color. Five primary colors are mixed, and coordinates of the fourth and fifth primary colors, for example, [Y]-yellow and [M]-magenta, are not within a color gamut triangle formed by coordinates of original [R], [G], and [B]. Therefore, theoretical colors achieved through color mixing are within a pentagonal color gamut having [R], [G], [B], [Y], and [M] as vertices, and the theoretical number of color mixing is $256^5=1099511627776$, which is far greater than 16777216 achieved by mixing three primary colors.

Figure 7:
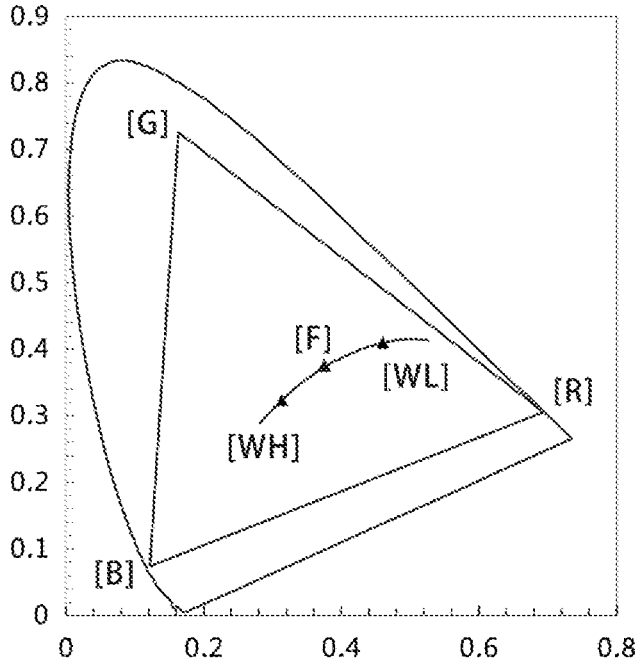
FIG. 7 is a schematic diagram of applications of white light generated at different color temperatures by mixing five primary colors in another embodiment according to the present disclosure.

Then as shown in FIG. 7, R, G, and B are coordinates of mixed three primary colors, [WL] and [WH] are the fourth and fifth mixed primary colors, and [F] is coordinates of white light generated through final color mixing. In this embodiment, the fourth and fifth colors, for example, [WL]-2700K white light and [WH]-6500K white light, at different color temperatures are within a color gamut triangle of original [R], [G], and [B]. Therefore, by mixing the five primary colors, color temperature changes from 2700K to 6500K, high light efficiency and a high color rendering index can be achieved, to meet requirements of variable lighting environment.

Through experiments of the applicant, white light at 3500K, 4000K, 4500K, 5000K, 5500K, and 6000K color temperatures generated by mixing four primary colors of white light +R+G+B at the 5500K color temperature has high light efficiency and color rendering index. Color rendering indexes when grades of color temperatures are achieved through color mixing are shown in the following table:

| | Color temperature | | | | | |
|---|---|---|---|---|---|---|
| | 3500 K | 4000 K | 4500 K | 5000 K | 5500 K | 6000 K |
| Color rendering index | 84 | 90 | 94 | 95 | 96 | 96 |

It should be noted that embodiments shown in FIGS. 5 to 7 are solutions regarding mixture of five primary colors, which are not limited thereto. A person skilled in the art should derive solutions of mixture of four primary colors and more than five primary colors without doubt according to the foregoing teaching. Therefore, the solutions are not described herein.

In conclusion, the LED light source apparatus according to the present disclosure comprises: a plurality of light mixing units, each light mixing unit includes LED chips of at least four colors, and the at least four colors at least include red and green; and the plurality of light mixing units is uniformly distributed on a bearing surface along a ring. Through light mixing of the at least four colors, colors are more abundant, high light efficiency and color rendering index are achieved.

The present disclosure effectively overcomes the disadvantages of the prior art to provide a highly industrially applicable value.

The foregoing embodiments are only to illustrate the principle and effects of the present disclosure and are not intended to limit the present disclosure. Any person skilled in the art can modify or change the foregoing embodiments without departing from the spirit and scope of the present disclosure. Therefore, all modifications and variations completed by a person with ordinary skill in the art without departing from the spirit and technical idea disclosed in the present disclosure should still be covered by the claims of the present disclosure.

What is claimed is:

1. A light emitting diode (LED) light source apparatus, comprising:

a plurality of light mixing units, wherein each light mixing unit comprises LED chips having at least four colors, and the at least four colors at least comprise red and green;

the plurality of light mixing units is uniformly distributed on a bearing surface along a first ring;

all of the LED chips in the plurality of light mixing units are uniformly distributed on the bearing surface along the first ring;

the LED chips of each light mixing unit have the same distance from the center of the first ring.

2. The LED light source apparatus according to claim 1, wherein a heat conductive connecting layer is disposed between the plurality of light mixing units and the bearing surface, and the heat conductive connecting layer is provided with a conductive circuit electrically connected to the LED chips in the light mixing units.

3. The LED light source apparatus according to claim 1, wherein the bearing surface is a surface of a base.

4. The LED light source apparatus according to claim 3, an auxiliary heat dissipation structure is provided on the base, the auxiliary heat dissipation structure comprises a hollow ventilation portion and/or heat-dissipation ribs.

5. The LED light source apparatus according to claim 1, wherein each light mixing unit comprises LED chips having four or five colors.

6. A light emitting diode (LED) lighting device, comprising an LED light source apparatus, wherein the LED light source apparatus comprises a plurality of light mixing units, each light mixing unit comprises LED chips having at least four colors, the at least four colors at least comprise red and green, the plurality of light mixing units is uniformly distributed on a bearing surface along a first ring, and all of the LED chips in the plurality of light mixing units are uniformly distributed on the bearing surface along the first ring;

the LED chips of each light mixing unit have the same distance from the center of the first ring.

7. A light emitting diode (LED) lighting control method, the method comprises:

controlling a color temperature and/or a color of light emitted from an LED lighting device, wherein the LED lighting device comprises an LED light source apparatus, the LED light source apparatus comprises a plurality of light mixing units, each light mixing unit comprises LED chips having at least four colors, the at least four colors at least comprise red and green, the plurality of light mixing units is uniformly distributed on a bearing surface along a first ring, and all of the LED chips in the plurality of light mixing units are uniformly distributed on the bearing surface along the first ring;

the LED chips of each light mixing unit have the same distance from the center of the first ring.

8. The lighting control method according to claim 7, wherein the color temperature ranges from 2700K to 6500K.

* * * * *